US010208630B2

(12) United States Patent
Kirchner et al.

(10) Patent No.: US 10,208,630 B2
(45) Date of Patent: Feb. 19, 2019

(54) METHOD FOR OPERATING A STEAM POWER PLANT AND STEAM POWER PLANT FOR CONDUCTING SAID METHOD

(71) Applicant: General Electric Technology GmbH, Baden (CH)

(72) Inventors: Julia Kirchner, Mannheim (DE); Volker Schule, Mannheim (DE)

(73) Assignee: General Electric Company, Schenectady, NY (US)

( * ) Notice: Subject to any disclaimer, the term of this patent is extended or adjusted under 35 U.S.C. 154(b) by 108 days.

(21) Appl. No.: 15/402,254

(22) Filed: Jan. 10, 2017

(65) Prior Publication Data

US 2017/0198609 A1 Jul. 13, 2017

(30) Foreign Application Priority Data

Jan. 13, 2016 (EP) ..... 16150983

(51) Int. Cl.
*F01K 7/16* (2006.01)
*F01K 7/40* (2006.01)
(Continued)

(52) U.S. Cl.
CPC ..... *F01K 7/26* (2013.01); *F01K 1/02* (2013.01); *F01K 1/10* (2013.01); *F01K 3/06* (2013.01);
(Continued)

(58) Field of Classification Search
CPC ..... F01K 7/26; F01K 3/06; F01K 7/40; F01K 3/26; F01K 7/025; F01K 3/14; F01K 1/02;
(Continued)

(56) References Cited

U.S. PATENT DOCUMENTS 3,890,789 A 6/1975 Beckmann et al.
6,210,467 B1 * 4/2001 Howard ..... C01B 32/50 95/172
(Continued)

FOREIGN PATENT DOCUMENTS

DE 898001 C 11/1953
DE 2360870 A1 6/1974
(Continued)

OTHER PUBLICATIONS

European Search Report and Opinion issued in connection with corresponding EP Application No. 16150983.1 dated Jun. 30, 2016.

*Primary Examiner* — Hoang M Nguyen
(74) *Attorney, Agent, or Firm* — Cynthia W. Flanigan; GPO Global Patent Operation

(57) ABSTRACT

A steam power plant and method for operation the steam power plant is provided, that comprises: a main water-steam-cycle with a high pressure (HP) steam turbine, an intermediate pressure (IP) steam turbine and a low pressure (LP) steam turbine, a condenser, and a feed water tank, wherein low pressure heaters are arranged between said condenser and said feed water tank and wherein a plurality of high pressure heaters are arranged downstream of said feed water tank, whereby said low pressure heaters, said feed water tank and said plurality of high pressure heaters are supplied with steam from a plurality of extractions at said steam turbines.

15 Claims, 3 Drawing Sheets

(51) Int. Cl.

| | |
|---|---|
| ***F01K 7/26*** | (2006.01) |
| ***F01K 9/00*** | (2006.01) |
| ***F01K 1/02*** | (2006.01) |
| ***F01K 1/10*** | (2006.01) |
| ***F01K 3/14*** | (2006.01) |
| ***F01K 3/26*** | (2006.01) |
| ***F01K 7/02*** | (2006.01) |
| ***F01K 7/22*** | (2006.01) |
| ***F01K 7/38*** | (2006.01) |
| ***F01K 3/06*** | (2006.01) |

(52) U.S. Cl.
CPC ..... *F01K 3/14* (2013.01); *F01K 3/26* (2013.01); *F01K 7/025* (2013.01); *F01K 7/22* (2013.01); *F01K 7/38* (2013.01); *F01K 7/40* (2013.01); *F01K 9/00* (2013.01)

(58) Field of Classification Search
CPC ..... F01K 7/22; F01K 7/38; F01K 1/10; F01K 9/00
USPC ..... 60/653, 677–680
See application file for complete search history.

(56) References Cited

U.S. PATENT DOCUMENTS

| | | | | |
|---|---|---|---|---|
| 6,764,530 | B2 * | 7/2004 | Iijima | B01D 53/1475 95/183 |
| 7,377,967 | B2 * | 5/2008 | Reddy | B01D 53/1406 423/228 |
| 7,895,822 | B2 * | 3/2011 | Hoffmann | F02C 3/02 60/39.5 |
| 2011/0048011 | A1 * | 3/2011 | Okita | F01K 7/18 60/649 |
| 2011/0265477 | A1 * | 11/2011 | Drouvot | F01K 17/02 60/653 |
| 2015/0143793 | A1 | 5/2015 | Feller et al. | |

FOREIGN PATENT DOCUMENTS

| | | | |
|---|---|---|---|
| DE | 102012213976 | A1 | 2/2014 |
| EP | 2589760 | A1 | 5/2013 |
| EP | 2589761 | A1 | 5/2013 |
| EP | 2333254 | B1 | 11/2015 |
| JP | S57119116 | A | 7/1982 |
| JP | S60187705 | A | 9/1985 |
| WO | 2014044254 | A2 | 3/2014 |

* cited by examiner

METHOD FOR OPERATING A STEAM POWER PLANT AND STEAM POWER PLANT FOR CONDUCTING SAID METHOD

TECHNICAL FIELD

Embodiments of the present invention relate to a steam power plant and a method for operating a steam power plant.

Embodiments further refer to a steam power plant for conducting said method.

BACKGROUND

In the past various attempts have been made to store energy in a steam power plant in order to use it during certain operational conditions.

One attempt suggests a steam power having, parallel to the low pressure preheater passage, a heat reservoir, which is loaded with preheated condensate in weak-load times. This preheated condensate is taken from the heat reservoir for generating peak-load and inserted downstream of the preheater passage into the condensate line and the feed water tank, respectively. Thus it is possible to quickly control the power generation of the power plant in a wide range without significantly having to change the heating output of the boiler of the steam generator. A steam power plant equipped according to embodiments of the invention can thus be operated with bigger load modifications and also provide more control energy.

In another attempt, a steam power plant has, parallel to the low-pressure passage, a heat reservoir which is loaded with preheated condensate in weak-load times. This preheated condensate is taken from the heat reservoir for generating peak-load and inserted downstream of the low-pressure preheater passage into the condensate line and the feed water tank, respectively. An additional heat exchanger is provided to increase the temperature of the hot water sent to the storage. Thus it is possible to quickly control the power generation of the power plant in a wide range without significantly having to change the heating output of the boiler of the steam generator. A steam power plant equipped according to embodiments of the invention can thus be operated with bigger load modifications and also provide more control energy.

In yet another attempt, the integration of hot water energy storage is parallel to the HP feed water preheaters. In this case the storage is at higher temperatures and pressures than in previous attempts mentioned before.

In yet another attempt, a method involving extracting a portion of a steam mass flow from a boiler connected to a water-steam circuit of a steam turbine into an external storage. The steam is released from the external storage and supplied to the steam turbine process when needed. The steam is extracted into the external storage, when the power plant is operated at partial load or when a rapid power reduction is required. The steam turbine is operated in modified variable pressure, and the boiler is filled with the steam while the steam is released from the external storage. Here, during charging the storage is fed by steam from the boiler.

For power plants, where no storage is already installed, one of the above attempts may provide the best solutions. But when a power plant has already a steam storage installed but not dedicated to use it to provide additional power, it is the most cost-effective solution to integrate the existing steam storage in a different way.

BRIEF DESCRIPTION

It is an object of the present invention to provide a method for operating a steam power plant, which is capable of storing energy in order to utilize the fluctuation of the electricity price to earn additional revenues (arbitration).

It is a further object of the present invention to provide a steam power plant for conducting said method.

These objectives are obtained by a method and a steam power plant as disclosed herein.

The inventive method for operating a steam power plant is based on a steam power plant comprising: a main water-steam-cycle with a high pressure (HP) steam turbine, an intermediate pressure (IP) steam turbine and a low pressure (LP) steam turbine, a condenser, and a feed water tank, wherein low pressure heaters are arranged between said condenser and said feed water tank and wherein a plurality of high pressure heaters are arranged downstream of said feed water tank, whereby said low pressure heaters, said feed water tank and said plurality of high pressure heaters are supplied with steam from a plurality of extractions at said steam turbines.

The inventive method comprises the steps of: providing a steam storage tank within said steam power plant, storing during a first operation period of said steam power plant steam in said steam storage tank, and discharging during a second operation period of said steam power plant steam stored in said steam storage tank into the main water steam cycle to save steam extracted from said plurality of extractions at said steam turbines.

An embodiment of the inventive method is characterized in that during said first operation period steam extracted from said high pressure (HP) steam turbine is stored in said steam storage tank, a first of said plurality of high pressure heaters is supplied with steam extracted from said intermediate pressure (IP) steam turbine, and steam is discharged into said first of said plurality of high pressure heaters from said steam storage tank during said second operation period of said steam power plant.

Said steam discharged from said steam storage tank into said first of said plurality of high pressure heaters during said second operation period may be superheated with steam extracted from said high pressure (HP) steam turbine.

Alternatively, said steam discharged from said steam storage tank into said first of said plurality of high pressure heaters during said second operation period may be superheated with hot reheat steam, which is available at the inlet of said intermediate pressure (IP) steam turbine.

Alternatively, said steam discharged from said steam storage tank into said first of said plurality of high pressure heaters during said second operation period is superheated with steam, which is extracted from said intermediate pressure (IP) steam turbine for supplying said first of said plurality of high pressure heaters.

Another embodiment of the inventive method is characterized in that during said first operation period steam extracted from said high pressure (HP) steam turbine is stored in said steam storage tank, said feed water tank is supplied with steam extracted from said intermediate pressure (IP) steam turbine, and steam is discharged into said feed water tank from said steam storage tank during said second operation period of said steam power plant.

Said steam discharged from said steam storage tank into said feed water tank may be superheated with steam extracted from said high pressure (HP) steam turbine.

Alternatively, said steam discharged from said steam storage tank into said feed water tank may be superheated with hot reheat steam, which is available at an inlet of said intermediate pressure (IP) steam turbine.

Alternatively, a first of said plurality of high pressure heaters is supplied with steam extracted from said intermediate pressure (IP) steam turbine, and said steam discharged from said steam storage tank into said feed water tank may be superheated with steam, which is extracted from said intermediate pressure (IP) steam turbine for supplying said first of said plurality of high pressure heaters.

Alternatively, said steam discharged from said steam storage tank into said feed water tank may be superheated with steam extracted from said intermediate pressure (IP) steam turbine for being supplied to said feed water tank.

A steam power plant according to embodiments of the invention for conducting said inventive method comprises: a steam-water-cycle with a high pressure steam turbine, an intermediate pressure steam turbine and a low pressure steam turbine, a condenser, and a feed water tank, wherein low pressure heaters are arranged between said condenser and said feed water tank and wherein first and second high pressure heaters are arranged downstream of said feed water tank, whereby said low pressure heaters, said feed water tank and said high pressure heaters are supplied with steam from a plurality of extractions at said steam turbines.

A steam storage tank with an input for receiving steam and an output for discharging steam is provided at said steam power plant, that said input of said steam storage tank is operationally connected to a steam extraction at said high pressure steam turbine, and that said output of said steam storage tank is operationally connected to said first high pressure heater.

Another steam power plant according to embodiments of the invention for conducting said inventive method comprises: a steam-water-cycle with a high pressure steam turbine, an intermediate pressure steam turbine and a low pressure steam turbine, a condenser, and a feed water tank, wherein low pressure heaters are arranged between said condenser and said feed water tank and wherein first and second high pressure heaters are arranged downstream of said feed water tank, whereby said low pressure heaters, said feed water tank and said high pressure heaters are supplied with steam from a plurality of extractions at said steam turbines.

A steam storage tank with an input for receiving steam and an output for discharging steam is provided at said steam power plant, that said input of said steam storage tank is operationally connected to a steam extraction at said high pressure (HP) steam turbine, and that said output of said steam storage tank is operationally connected to said feed water tank.

Especially, steam extracted from said steam storage tank may be superheated with steam extracted from said high pressure (HP) steam turbine or hot reheat steam, which is available at the inlet of said intermediate pressure (IP) steam turbine, or steam, which is extracted from said intermediate pressure (IP) steam turbine for supplying said first of said high pressure heaters.

Furthermore, steam extracted from said steam storage tank may be superheated with steam extracted from said intermediate pressure (IP) steam turbine for being supplied to said feed water tank.

BRIEF DESCRIPTION OF THE DRAWINGS

Embodiments of the present invention will now be explained more closely and with reference to the attached drawings.

DETAILED DESCRIPTION

The main objective is the integration of thermal energy storage (steam storage) into a steam power plant. During discharging of the steam storage tank, the steam is fed to the main water-steam cycle to save extraction steam. By doing this, the power output of the plant can be increased.

Figure 1:
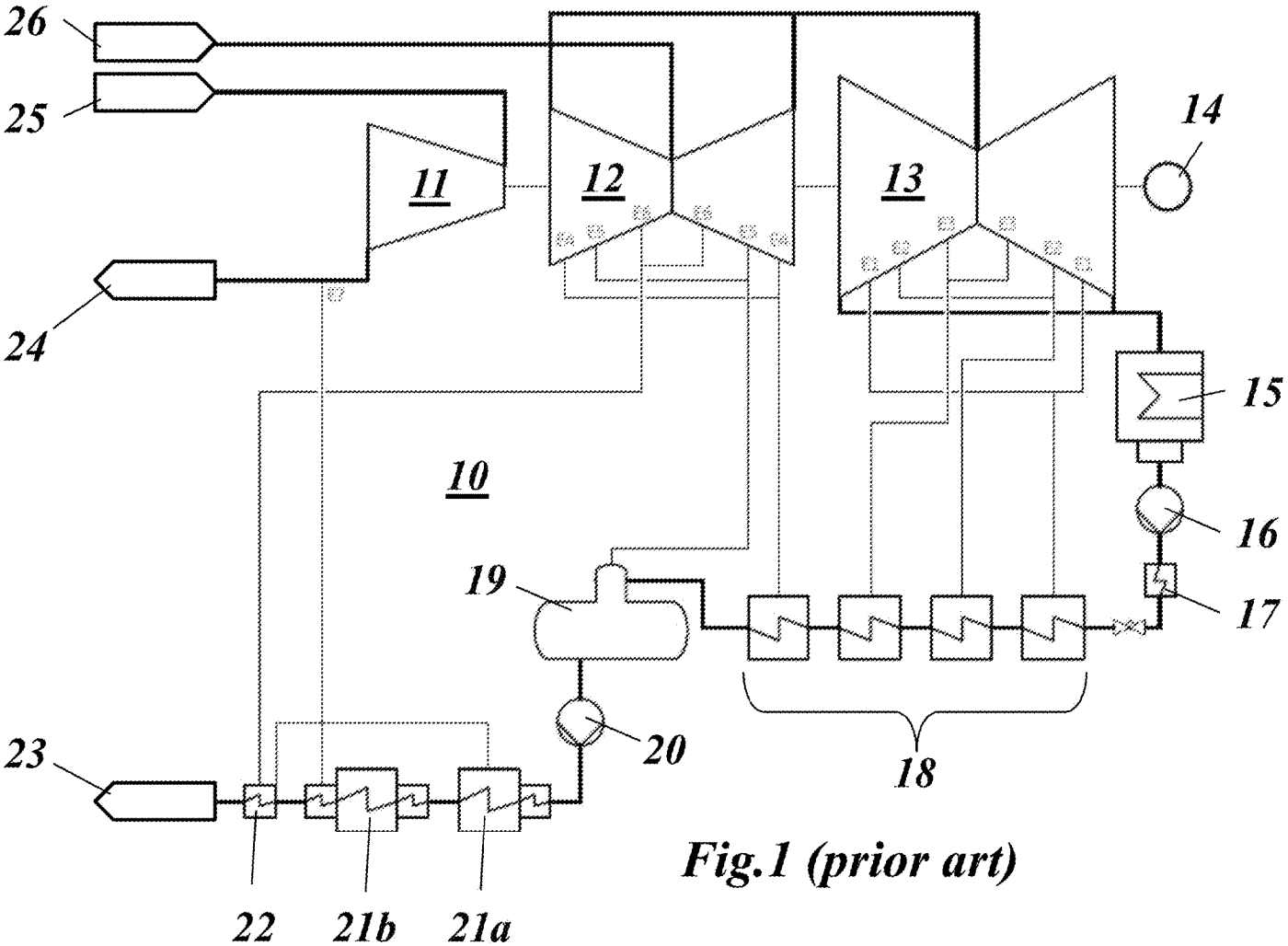
Fig.1 (prior art)
FIG. 1 shows a prior art basic water-steam-cycle arrangement.

The basis is a prior art steam power plant shown in FIG. 1. The steam power plant 10 of FIG. 1 comprises a high pressure (HP) steam turbine 11, intermediate pressure (IP) steam turbines 12 and low pressure (LP) steam turbines 13, which drive a generator 14. Life steam 25 is supplied to high pressure steam turbine from a boiler (or heat recovery steam generator HRSG) not shown. After expansion in high pressure steam turbine 11 steam is fed back to cold reheat 24 of the boiler. Hot reheat 26 steam from the boiler is then supplied to intermediate pressure (IP) steam turbines 12 the exits of which are connected to the inlet of low pressure (LP) steam turbines 13.

Steam from the low pressure (LP) steam turbines 13 flows into condenser 15. The resulting condensate is pumped by condensate pump 16 through heat exchanger 17 and a series of low pressure heaters (LPH) 18 to feed water tank 19. From feed water tank 19 a feed water pump 20 pumps feed water through high pressure heaters (HPH) 21*a* and 21*b* and desuperheater (DeSH) 22 to an economizer 23 of a boiler/heat recovery steam generator (not shown).

The low pressure heaters 18 are supplied with steam extracted at various points of low pressure steam turbines 13 and intermediate pressure steam turbines 12 (extractions E1 to E4). Feed water tank 19 receives steam from extraction E5 of intermediate pressure steam turbines 12, while first high pressure heater 21*a* and desuperheater 22 are connected to extraction E6 of intermediate pressure steam turbines 12. Second high pressure heater 21*b* receives steam from extraction E7, i.e. directly from the outlet of high pressure steam turbine 11.

An HP extraction is not shown in the drawing of FIG. 1, but can also be possible.

Now, in general, the higher the pressure of the extraction steam, the longer is the path in the steam turbine where the steam can deliver "work". If the mass flows were similar, this would be true. But for a steam storage, the lower the minimum pressure, the more mass can be extracted from the storage and so, integration of a steam storage at a lower stage can result in even higher electrical power output increase.

When the maximum storage pressure is the cold reheat (CRH) pressure at 24, the storage cannot be connected to the second high pressure heater 21*b* (in FIG. 1), as the pressure decreases when extracting steam from the storage. Therefore, the first possible feed water preheater in descending order is the first high pressure heater 21*a*. If there are several high pressure feed water preheaters, the storage can be connected to either of them, which has a pressure lower than the storage pressure.

Depending on the source of superheating steam, it can occur that the steam pressure from the storage is a little bit below the original extraction pressure (depending on pressure drops in the system).

Figure 2:
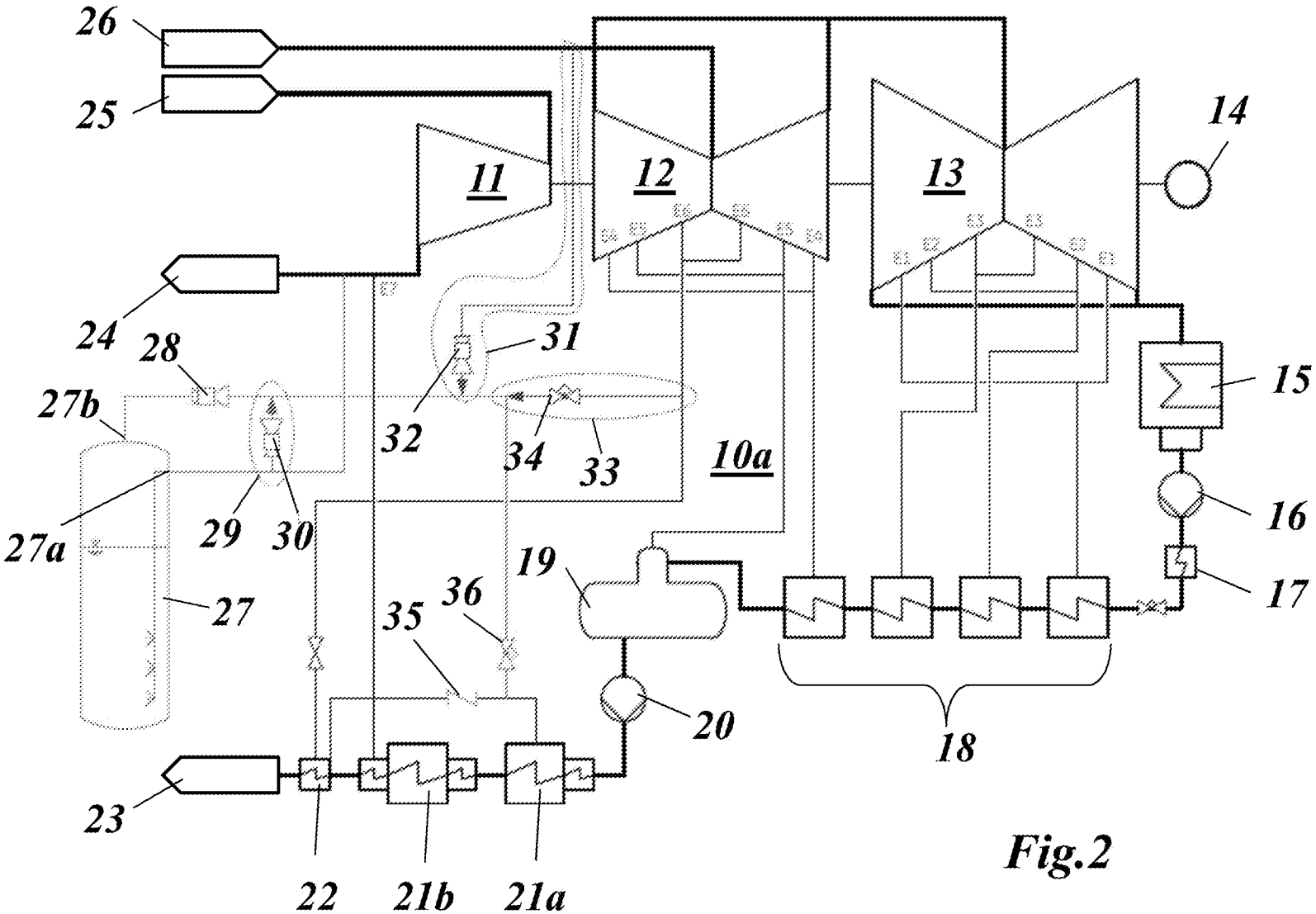
FIG. 2 shows a steam storage integration at a high pressure heater, in a water-steam-cycle arrangement as shown in FIG. 1 according to an embodiment of the invention.

FIG. 2 now shows an embodiment of the invention, where a steam storage tank 27 is integrated at high pressure heater 21*a*.

If this high pressure heater 21*a* is connected to the IP steam turbine 12 (extraction E6), it will have a high temperature (approx. 400° C. and more) and a pressure lower than the cold reheat pressure at 24 (approx. 25 bars).

There are different ways to superheat the steam from storage tank 27.

According to a first superheat option 29 (valve 30), the steam from storage tank 27 can be superheated with cold reheat 24 from the exit of high pressure steam turbine 11.

According to a second superheat option 31 (valve 32), the steam from storage tank 27 can be superheated with hot reheat 26, i.e. steam supplied to the inlet of intermediate pressure steam turbines 12.

According to a third superheat option 33 (valve 34) the steam from storage tank 27 can be superheated with steam from extraction E6 at intermediate pressure steam turbine 12 to high pressure heater 21*a*. Further valves 28, 35 and 36 are provided to complete the described functionality.

If the degree of superheating of the steam is rather low, it only makes sense to shut off the desuperheater 22 of that high pressure preheater 21*a* and introduce the steam from the storage tank 27 directly at the condensing part. If there is no non-return valve between desuperheater 22 and the condensing part (valve 35), it must be retrofitted. Third superheat option 33 has the highest storage efficiency of the three superheating variants explained above.

Furthermore, a throttle valve (valve 28) controls the pressure to the pressure of the high pressure heater 21*a*.

Figure 3:
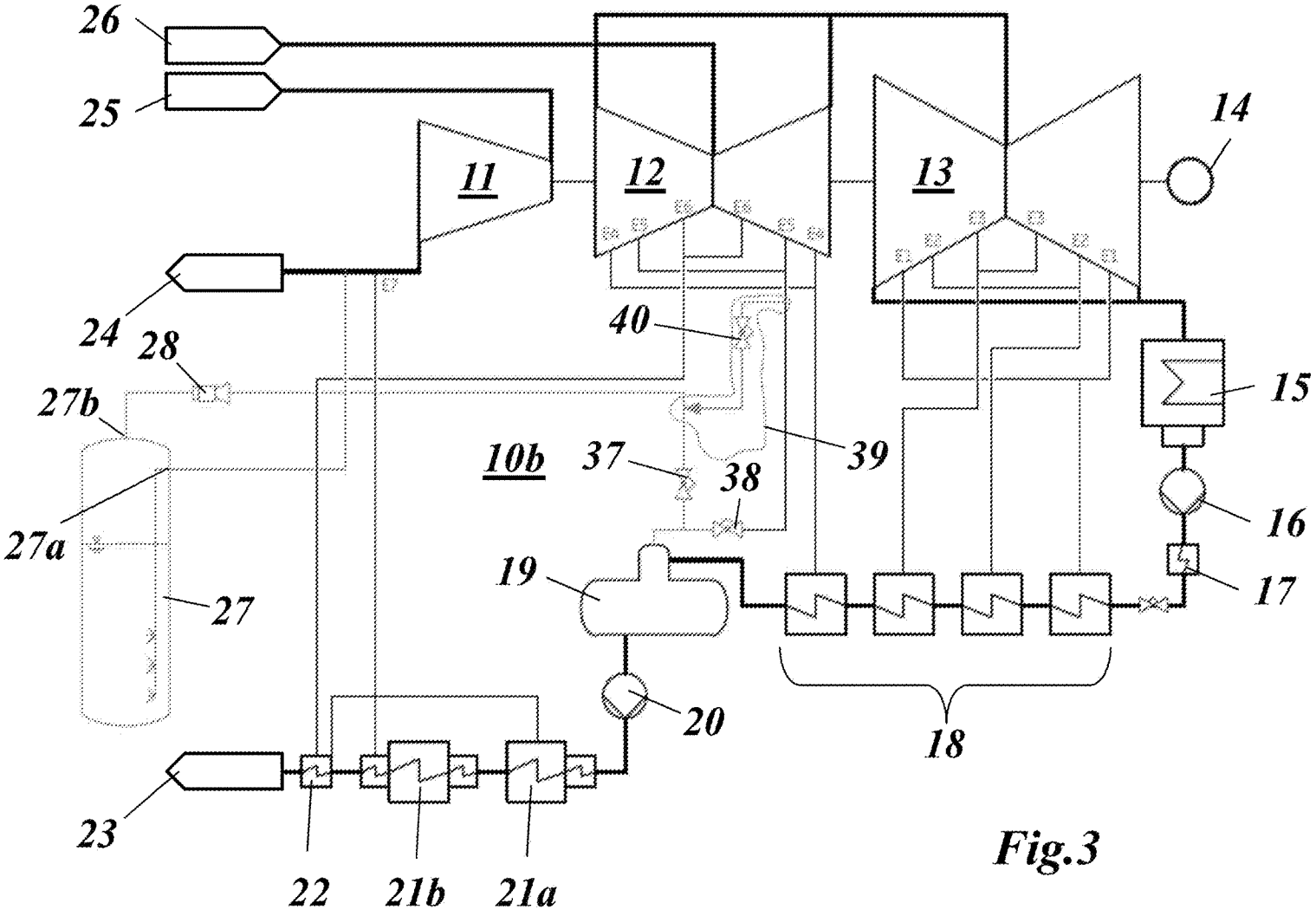
FIG. 3 shows a steam storage integration at the feed water tank, in a water-steam-cycle arrangement as shown in FIG. 1 according to another embodiment of the invention.

Another embodiment of the invention is shown in FIG. 3. According to FIG. 3 the steam storage tank 27 is integrated at feed water tank 19. When integrating the steam from the storage tank 27 at feed water tank 19, which is at a pressure level of approx. 10 bars, more steam can be extracted from the storage tank 27. A throttle valve 28 downstream the storage tank 27 will also be necessary.

To superheat the storage steam, the three superheating options explained above are possible.

A fourth option 39, using steam from the extraction E5 of the feed water tank 19 is possible. This solution delivers a higher electrical power increase, but has slightly slower storage efficiency than when integrating at high pressure heater 21*a*.

The throttle valve 28 controls the pressure to the feed water tank pressure. With a closed stop valve 38, the original extraction steam flow cannot enter the feed water tank 19. Valves 37 and 40 are provided to complete the described functionality.

Although the disclosure has been herein shown and described in what is conceived to be the most practical exemplary embodiment, the present disclosure can be embodied in other specific forms. For example, the exemplary power plant may only has two low pressure heaters, and/or a feed water tank connected to a lower extraction, and/or more than two high pressure heaters. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

What is claimed is:

1. A method for operating a steam power plant, said steam power plant comprising:

a main water steam cycle with a high pressure steam turbine, an intermediate pressure steam turbine and a low pressure steam turbine;

a condenser; and a feed water tank, wherein a plurality of low pressure heaters are arranged between said condenser and said feed water tank and wherein a plurality of high pressure heaters are arranged downstream of said feed water tank, whereby said low pressure heaters, said feed water tank and said plurality of high pressure heaters are supplied with steam from a plurality of extractions of said steam turbines, said method comprising the steps of:

providing a steam storage tank within said steam power plant;

storing, during a first operation period of said steam power plant, steam in said steam storage tank;

discharging, during a second operation period of said steam power plant, steam stored in said steam storage tank, during said first operation period, into the main water steam cycle to save steam extracted from said plurality of extractions at said steam turbines; and wherein during said first operation period:

steam extracted from said high pressure steam turbine is stored in said steam storage tank;

a first of said plurality of high pressure heaters is supplied with steam extracted from said intermediate pressure steam turbine;

steam is discharged into said first of said plurality of high pressure heaters from said steam storage tank during said second operation period of said steam power plant; and wherein said steam discharged from said steam storage tank into said first of said plurality of high pressure heaters during said second operation period is superheated with a steam extracted from said high pressure (HP) steam turbine.

2. The method of claim 1, wherein said steam discharged from said steam storage tank into said first of said plurality of high pressure heaters during said second operation period is superheated with a hot reheat steam, which is available at an inlet of said intermediate pressure steam turbine.

3. The method of claim 1, wherein said steam discharged from said steam storage tank into said first of said plurality of high pressure heaters during said second operation period is superheated with steam, which is extracted from said intermediate pressure steam turbine for supplying said first of said plurality of high pressure heaters.

4. The method of claim 1, wherein during said first operation period steam extracted from said high pressure steam turbine is stored in said steam storage tank, said feed water tank is supplied with steam extracted from said intermediate pressure steam turbine, and steam is discharged into said feed water tank from said steam storage tank during said second operation period of said steam power plant.

5. The method of claim 4, wherein said steam discharged from said steam storage tank into said feed water tank is superheated with a steam extracted from said high pressure steam turbine.

6. The method of claim 4, wherein said steam discharged from said steam storage tank into said feed water tank is superheated with a hot reheat steam, which is available at an inlet of said intermediate pressure steam turbine.

7. The method of claim 4, wherein a first of said plurality of high pressure heaters is supplied with steam extracted from said intermediate pressure steam turbine, and said steam discharged from said steam storage tank into said feed water tank is superheated with a steam, which is extracted from said intermediate pressure (IP) steam turbine for supplying said first of said plurality of high pressure heaters.

8. The method of claim 4, wherein said steam discharged from said steam storage tank into said feed water tank is superheated with steam extracted from said intermediate pressure steam turbine for being supplied to said feed water tank.

9. A steam power plant, comprising:

a steam-water-cycle with a high pressure steam turbine, an intermediate pressure steam turbine, and a low pressure steam turbine;

a condenser;

a feed water tank;

a plurality of low pressure heaters arranged between said condenser and said feed water tank;

a first and a second high pressure heater, wherein the first and the second high pressure heaters are arranged downstream of said feed water tank, whereby said low pressure heaters, said feed water tank and said first and second high pressure heaters are supplied with steam from a plurality of extractions at said steam turbines;

a steam storage tank configured to input and output steam within the steam power plant, wherein said steam storage tank is operationally connected to a steam extraction at said high pressure steam turbine and said steam storage tank is configured to feed output steam to said first high pressure heater or said feed water tank and is operationally connected to said feed water tank;

wherein steam extracted from said steam storage tank is superheated with steam extracted from said high pressure steam turbine, or hot reheat steam, which is available at an inlet of said intermediate pressure steam turbine, or steam extracted from said intermediate pressure steam turbine for supplying said first high pressure heater; and wherein steam extracted from said steam storage tank is superheated with steam extracted from said intermediate pressure steam turbine for supplying said feed water tank.

10. A method for superheating steam in a steam power plant, the method comprising:

providing a steam storage tank within said steam power plant;

extracting steam from a plurality of high pressure, intermediate pressure, and low pressure steam turbines within the steam power plant;

storing the extracted steam in said steam storage tank during a first period of operation;

supplying a first of a plurality of high pressure heaters located in the steam power plant with the extracted steam from said intermediate pressure steam turbines;

discharging steam from said steam storage tank into said first of said plurality of high pressure heaters during a second period of operation; and superheating said steam discharged from said steam storage tank.

11. The method of claim 10, wherein the steam discharged from the steam storage tank is superheated with cold reheat steam from the exit of said high pressure steam turbine.

12. The method of claim 10, wherein the steam discharged from the steam storage tank is superheated with hot reheat steam supplied to the inlet of said intermediate pressure steam turbine.

13. The method of claim 10, wherein the steam discharged from the steam storage tank is superheated with steam from extraction at said intermediate pressure steam turbine being supplied to said first of said plurality of high pressure heaters.

14. The method of claim 10, further comprising integrating the steam from the steam storage tank at a feed water tank, wherein the pressure at the feed water tank is about 10 bars.

15. The method of claim 14, wherein the steam discharged from the steam storage tank is superheated with steam extracted from said feed water tank.

* * * * *